US005531335A

United States Patent [19]

Chen

[11] Patent Number: 5,531,335

[45] Date of Patent: Jul. 2, 1996

[54] HANGER SUPPORTER ASSEMBLY

[76] Inventor: Shou-Mao Chen, 58, Ma Yuan West St., Taichung, Taiwan

[21] Appl. No.: 412,903

[22] Filed: Mar. 27, 1995

[51] Int. Cl.[6] ..... A47F 5/00

[52] U.S. Cl. ..... 211/124; 206/279; 206/287; 206/291; 248/316.4; 248/316.5

[58] Field of Search ..... 211/124, 8, 113; 248/316.4, 316.5, 316.6; 206/279, 287, 287.1, 291

[56] References Cited

U.S. PATENT DOCUMENTS

| | | | |
|---|---|---|---|
| 4,732,270 | 3/1988 | Myers et al. | 211/124 X |
| 4,769,878 | 9/1988 | Liao | 211/124 X |
| 4,852,845 | 8/1989 | Lener | 211/124 X |
| 4,880,113 | 11/1989 | Mobley | 206/291 X |
| 4,907,774 | 3/1990 | Shaw et al. | 211/124 X |
| 5,320,228 | 6/1994 | Chen | 211/124 |
| 5,400,900 | 3/1995 | Meyers et al. | 211/124 X |

*Primary Examiner*—Robert W. Gibson, Jr.

[57] ABSTRACT

A hanger supporter includes a frame including an upper beam and a lower beam inclined relative to the upper beam. A slide includes one end having an axle slidably engaging with a slot of the lower beam. A lever includes a lower end pivotally coupled to the front end of the lower beam at the pivot axis, a middle portion pivotally coupled to the slide, and includes another end for engaging with the upper beam. The slide is disengaged from the upper beam for engaging with the hangers and is engaged with the upper beam for stably retaining the hangers in place.

1 Claim, 3 Drawing Sheets

HANGER SUPPORTER ASSEMBLY

BACKGROUND OF THE INVENTION

1. Field of the Invention

The present invention relates to a support device, and more particularly to a supporter assembly for supporting hangers.

2. Description of the Prior Art

A typical hanger support is shown in FIGS. 1 and 2 and is fixed in a casing or a cabinet 99 for supporting hangers thereon. The hanger support comprises a board 91 having two holes 92 formed therein for fixing to the casing 99, and a panel 94 having two notches 95 formed in the front portion thereof. A beam 90 is formed in parallel to the panel 94 and arranged below the panel 94 so as to define a groove therebetween for engaging with the upper hook members of the typical hangers. The beam 90 includes a number of depressions 93 formed in the upper portion for engaging with and for positioning the hangers. A lock device 96 is pivotally coupled to the front portion of the beam 90 and includes two legs 97 for engaging with the notches 95 of the panel 94 so as to lock the hangers in place and so as to prevent the hangers from disengaging from the casing 99. However, the groove formed between the panel 94 and the beam 90 is so small that the hangers may not be easily inserted therein.

The present invention has arisen to mitigate and/or obviate the afore-described disadvantages of the conventional hanger supporters.

SUMMARY OF THE INVENTION

The primary objective of the present invention is to provide a hanger supporter assembly in which the hangers may be easily engaged in the supporter.

In accordance with one aspect of the invention, there is provided a hanger supporter assembly comprising a frame including an upper beam having a front end and including a lower beam inclined relative to the upper beam and having a slot means formed therein, the lower beam including a front end having a pivot axis provided therein, a slide including at least one depression formed therein and including a first end having a pivot axle extended therefrom for slidably engaging with the slot means of the lower beam, the slide including a second end having a pivot shaft provided therein, a lever including a first end pivotally coupled to the front end of the lower beam at the pivot axis, including a middle portion pivotally coupled to the second end of the slide at the pivot shaft, and including a second end for engaging with the upper beam, and means for engaging the second end of the lever to the upper beam. The slide is disengaged from the upper beam when the second end of the lever is disengaged from the upper beam, and the slide is engaged with the upper beam when the second end of the lever is engaged with the upper beam.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1A:
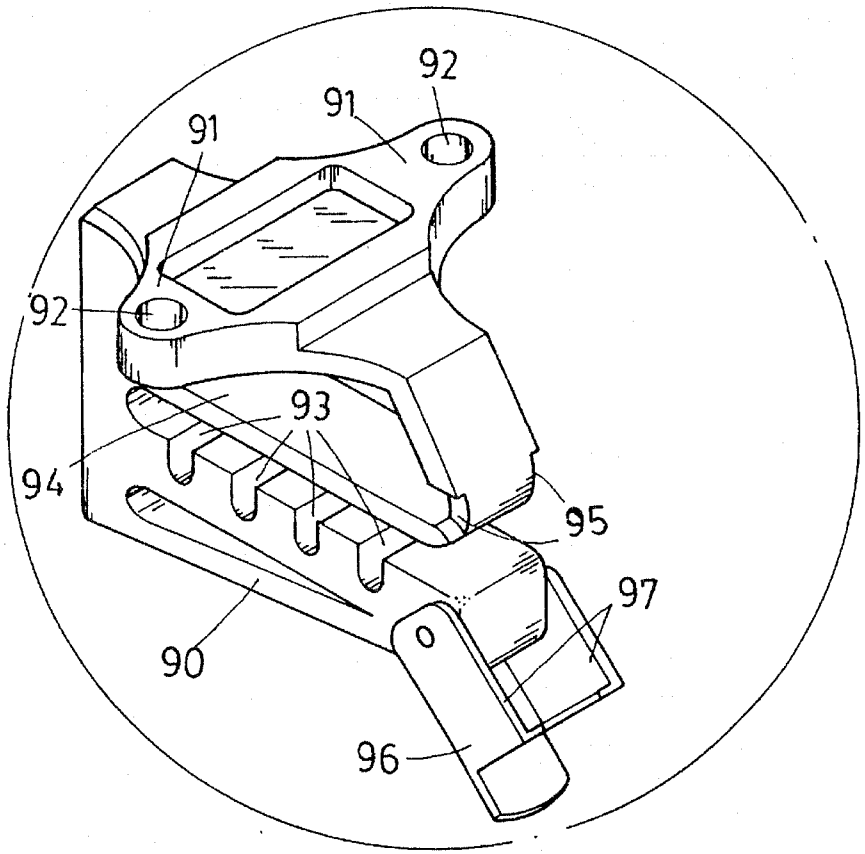
FIG. 1A PRIOR ART
FIG. 1A is a perspective view showing the typical hanger supporter device.
Figure 1:
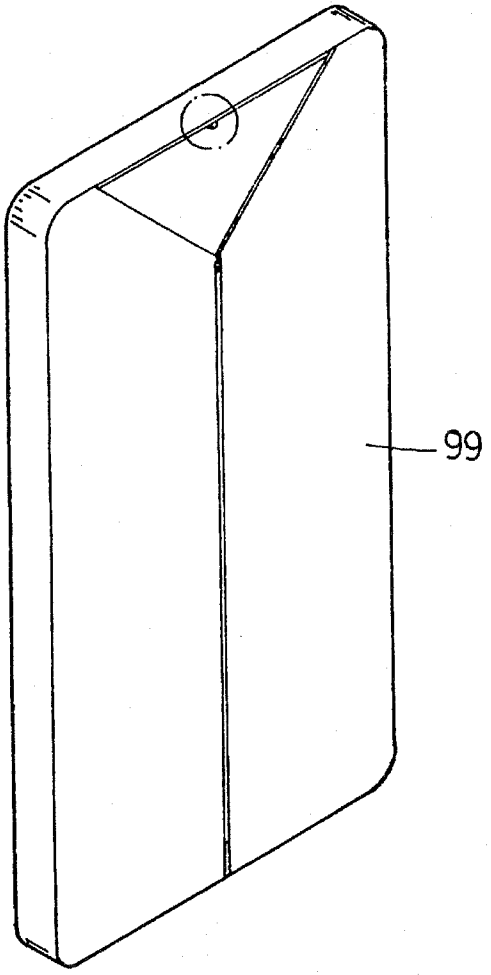
FIG. 1 PRIOR ART
FIG. 1 is a perspective view of a casing employing a typical hanger supporter device.
Figure 2:
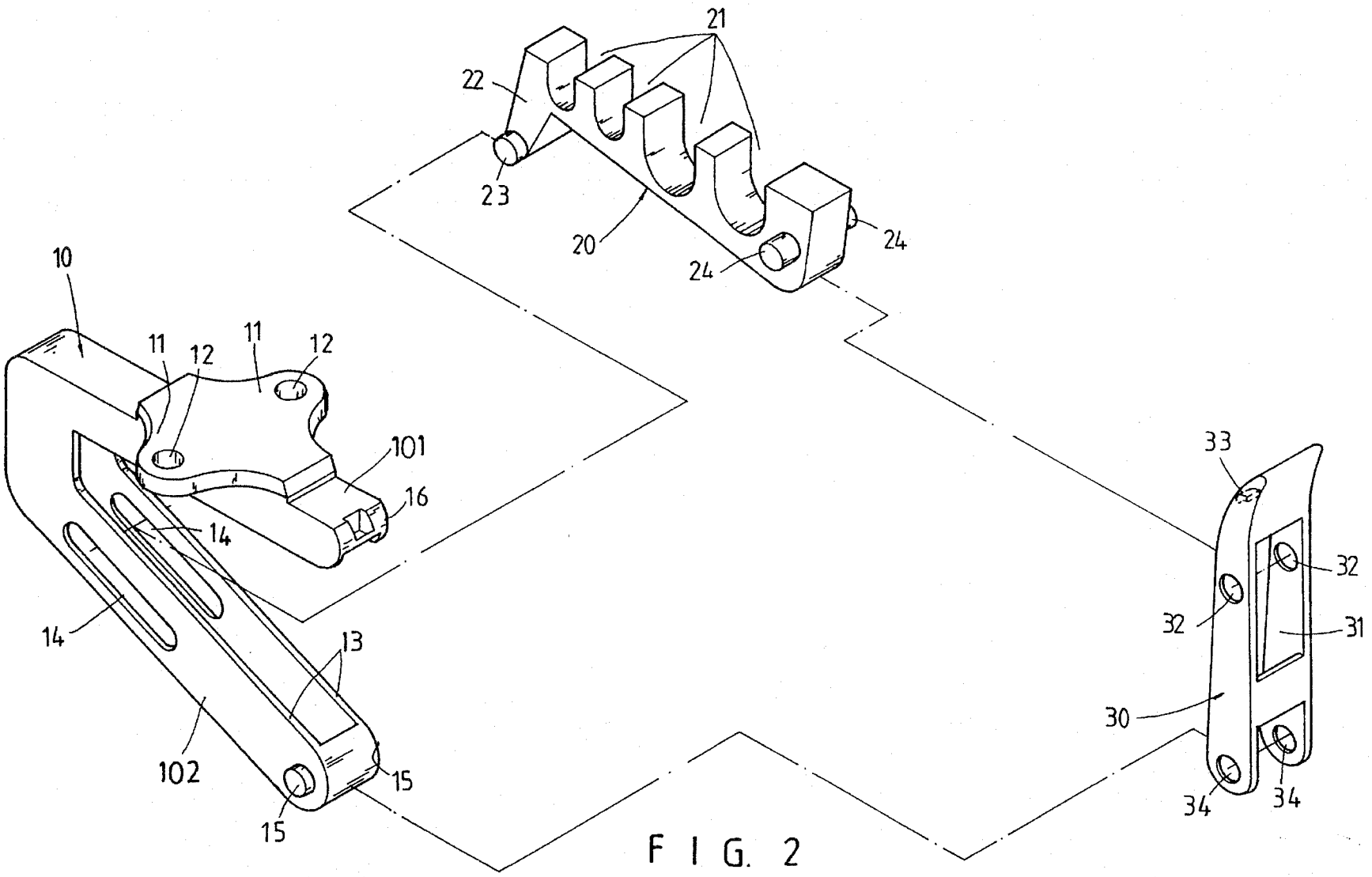
FIG. 2 is an exploded view of a hanger supporter assembly in accordance with the present invention.
Figure 3:
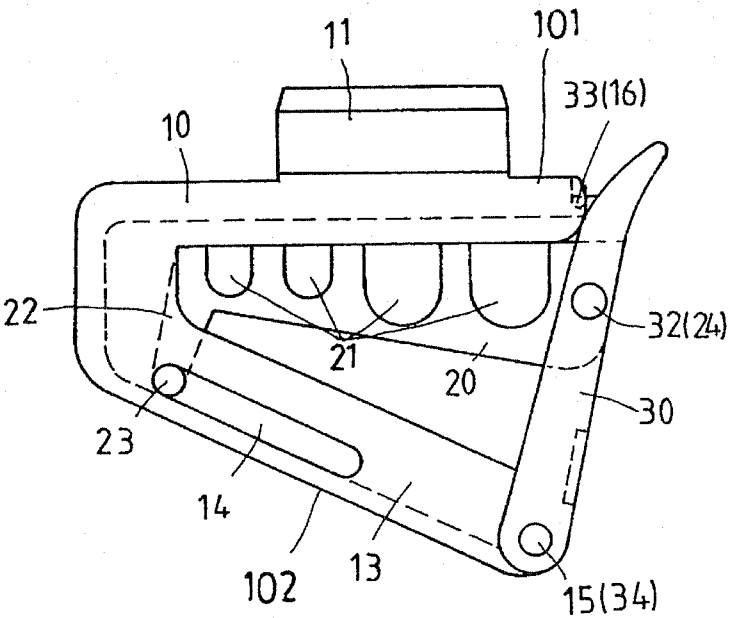

Referring to the drawings, and initially to FIGS. 2 and 3, a hanger supporter assembly in accordance with the present invention comprises a frame 10 includes an upper beam 101 having a board 11 fixed thereon. The board 11 includes two holes 12 for fixing the typical casings or cabinets. The upper beam 101 includes a recess 16 formed in the front end portion. The frame 10 further includes a lower beam 102 which is inclined relative to the upper beam 101 and which includes a pair of plates 13 having a pair of slots 14 formed therein. The lower beam 102 includes a front end having a pair of studs 15 laterally and oppositely extended therefrom so as to form a pivot axis.

A slide 20 includes a number of depressions 21 formed therein for engaging with and for supporting the upper hook members of the typical hangers. The slide 20 includes a rear portion 22 having a pair of extensions 23 laterally and oppositely extended therefrom so as to form a pivot axle and includes a front portion having a pair of projections 24 laterally and oppositely extended therefrom so as to form a pivot shaft. The extensions 23 are slidably engaged in the slots 14 of the plates 13. A lever 30 includes a lower end having two holes 34 formed therein for engaging with the studs 15 such that the lever 30 is rotatable about the pivot axis formed by the studs 15. The lever 30 includes a middle portion having a pair of holes 32 formed therein for engaging with the projections 24 such that the slide 20 also rotatable relative to the lever 30 about the pivot shaft formed by the projections 24. The lever 30 includes an opening 31 formed in the middle portion for receiving the end portion of the slide 20, best shown in FIG. 4. The lever 30 includes an upper end having a catch 33 formed therein for engaging with the recess 16 of the frame 10 so as to fix the lever 30 to the frame 10.

Figure 4:
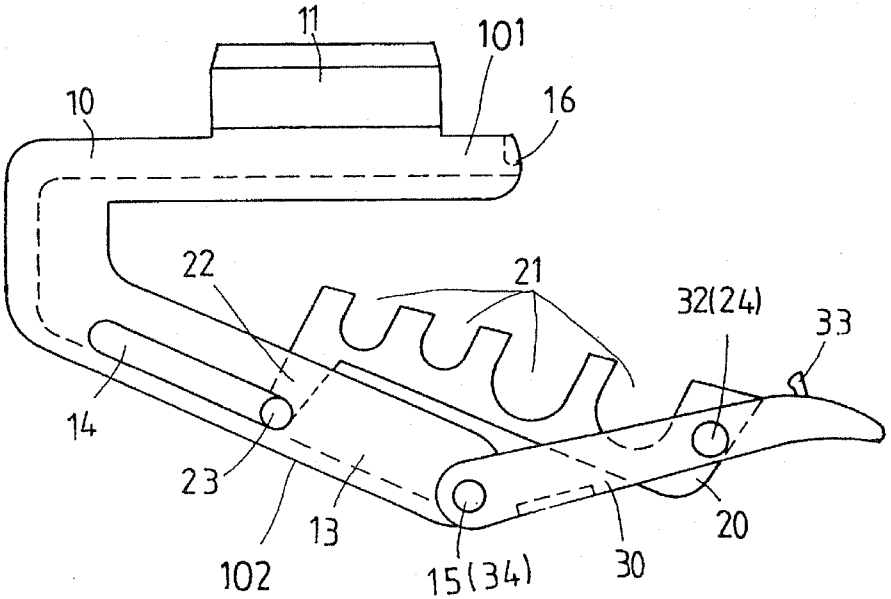
FIGS. 3 and 4 are plane views illustrating the operation of the hanger supporter assembly.

In operation, as shown in FIG. 4, when the lever 30 is not engaged with and fixed to the frame 10, the slide 20 is disengaged from the upper beam 101 of the frame 10 such that the typical hangers may be easily engaged with the depressions 21 of the slide 20. When the lever 30 is rotated relative to the pivot axis 15 and when the catch 33 is engaged with the recess 16 of the frame 10, the lever 30 may be locked to the frame 10 and the slide 20 may be moved upward to engage with the upper beam 101 of the frame 10 so as to solidly retain the hangers in place.

Accordingly, the hanger supporter assembly in accordance with the present invention includes a slide that may be disengaged from the upper beam of the frame such that the hangers may be easily engaged with or disengaged from the slide.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hanger supporter assembly comprising:

a frame including an upper beam having a front end and including a lower beam inclined relative to said upper beam and having a slot means formed therein, said lower beam including a front end having a pivot axis provided therein, a slide including at least one depression formed therein and including a first end having a pivot axle extended therefrom for slidably engaging with said slot means of said lower beam, said slide including a second end having a pivot shaft provided therein, a lever including a first end pivotally coupled to said front end of said lower beam at said pivot axis, including a middle portion pivotally coupled to said second end of said slide at said pivot shaft, and including a second end for engaging with said upper beam, and means for engaging said second end of said lever to said upper beam, said slide being disengaged from said upper beam when said second end of said lever is disengaged from said upper beam, and said slide being engaged with said upper beam when said second end of said lever is engaged with said upper beam.

* * * * *